US005806269A

United States Patent [19]

Corridon

[11] Patent Number: 5,806,269

[45] Date of Patent: Sep. 15, 1998

[54] METHOD OF INSTALLING CATHEDRAL CEILING FIXTURE MOUNTING SYSTEM

[76] Inventor: James M. Corridon, 503 SE. Glyndon St., Vienna, Va. 22180

[21] Appl. No.: 735,598

[22] Filed: Oct. 23, 1996

Related U.S. Application Data

[63] Continuation-in-part of Ser. No. 242,231, May 13, 1994, Pat. No. 5,592,788.

[51] Int. Cl.[6] ..... E04G 23/00

[52] U.S. Cl. ..... 52/745.2; 52/39; 52/745.1; 248/343; 144/365

[58] Field of Search ..... 52/745.2, 745.19, 52/39, 28, 57, 219, 741.1; 144/13, 359, 360, 363, 365; 362/147, 148, 150, 151, 152, 404; 248/220.1, 342, 343, 344

[56] References Cited

U.S. PATENT DOCUMENTS

| | | | |
|---|---|---|---|
| 917,324 | 4/1909 | Loving | 52/288.1 |
| 1,269,674 | 6/1918 | Bacigalupo | 52/608 |
| 2,032,030 | 2/1936 | Talen | 52/223.5 |
| 2,627,016 | 1/1953 | Hollinger | 362/147 |
| 2,651,086 | 9/1953 | Corson | 52/288.1 |
| 3,291,298 | 12/1966 | McCue | 52/57 |
| 5,179,811 | 1/1993 | Walker et al. | 52/288.1 |

FOREIGN PATENT DOCUMENTS

| | | | |
|---|---|---|---|
| 524965 | 8/1940 | United Kingdom | 52/287.1 |

*Primary Examiner*—Michael Safavi
*Attorney, Agent, or Firm*—Bergert & Bergert

[57] ABSTRACT

A method for providing a fixture mount can be used to provide a flush surface adjacent the ridge of a cathedral ceiling at the position where a ceiling fan or light fixture is to be supported. The method can be used to fit any common cathedral ceiling pitch and allows the user to mount a ceiling fan or fixture in a location such as the center of a room in an aesthetically pleasing manner. The method can employ a monolithic member or, alternatively, a base mount member and one or more pitch mount members stacked sequentially, with each successive pitch mount varying the pitch of the fixture mount employed.

7 Claims, 5 Drawing Sheets

10
46
B
48
42
42
C
50
44
44
40
52
50
52
50
52
52
50
46
42
48
42
40
44
38
44
36
36
34
32

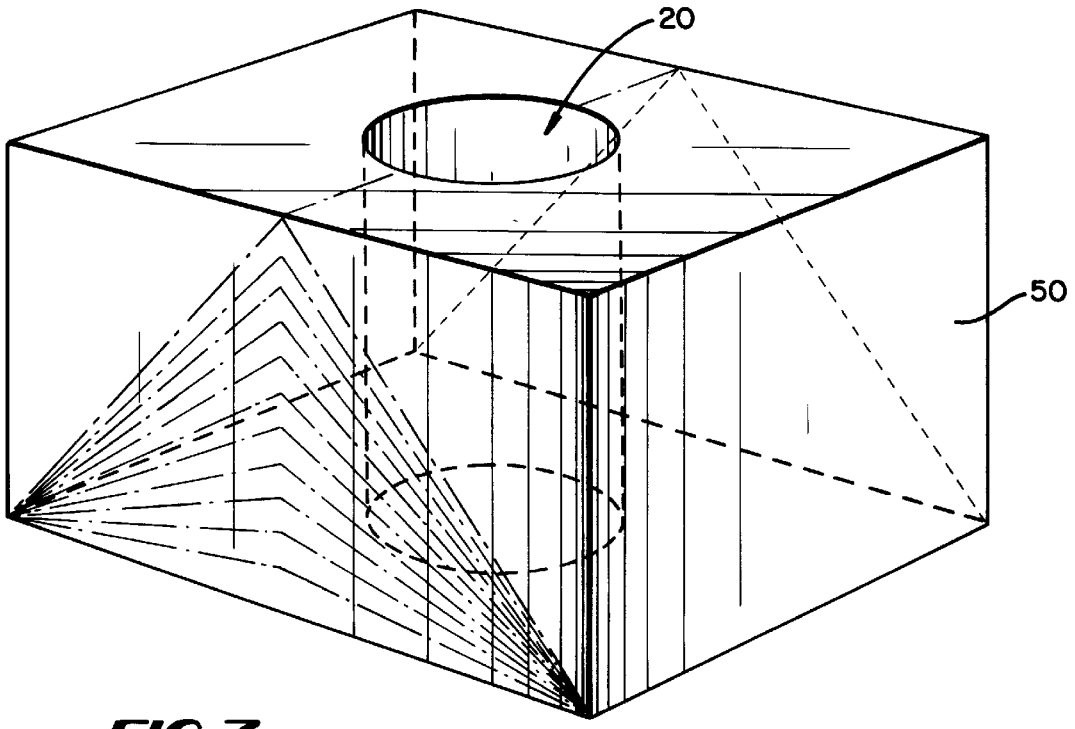
FIG. 7
FIG. 8
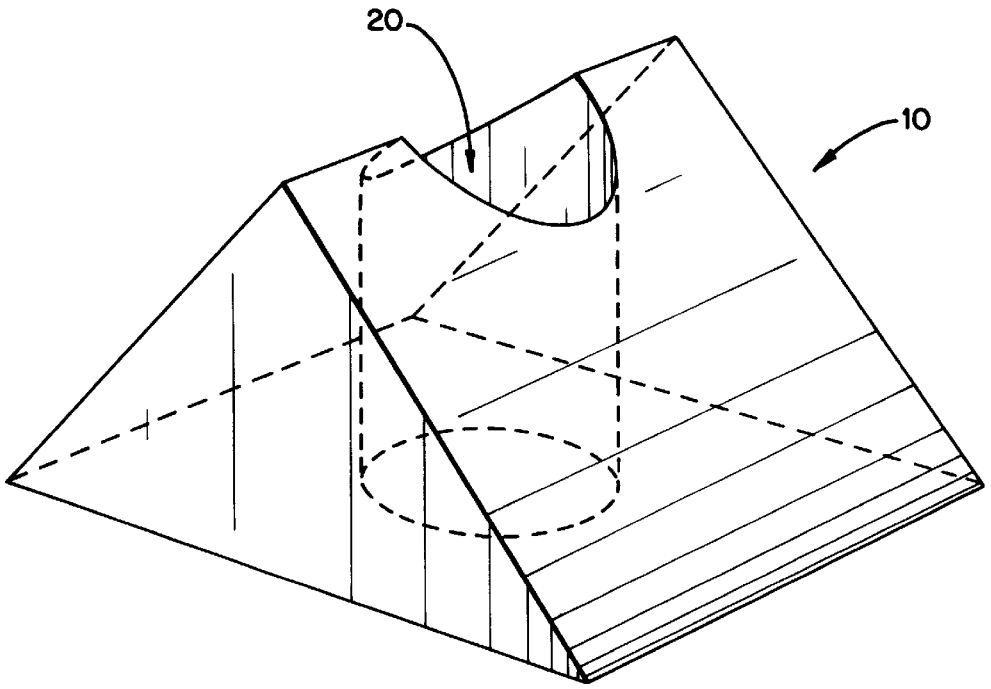

METHOD OF INSTALLING CATHEDRAL CEILING FIXTURE MOUNTING SYSTEM

CROSS REFERENCE TO RELATED APPLICATIONS

This is a continuation-in-part application of application Ser. No. 08/242,231, filed May 13, 1994, now U.S. Pat. No. 5,592,788.

BACKGROUND AND SUMMARY OF THE INVENTION

The present invention relates to the mounting of ceiling fixtures and more particularly to a method for providing a flat horizontal mounting surface to be placed at the ridge of a cathedral ceiling such that a light fixture or ceiling fan hanging from such a ceiling will have its less aesthetic components such as electrical wiring hidden from view.

Traditionally, ceiling fans and light fixtures have been mounted to flat ceilings by suspending the fan or fixture from a bracket attached to a beam in the ceiling in a position approximating the center of the room. A canopy or boot is then placed over the wiring box which houses the electrical wiring supplying the current to the fixture, so as to cover the electrical circuitry and provide an aesthetically pleasing appearance to the area adjacent the fixture.

Unfortunately, for those desiring to mount their fan or lighting fixture in the center of a room with a cathedral ceiling, the steep angles of cathedral ceilings have presented several problems. Since a cathedral ceiling does not have a flat surface, an unattractive gap is created between the fixture and the ridge of the ceiling. Some efforts, such as U.S. Pat. No. 5,090,654, for example, have avoided this problem altogether by mounting the fixture to one of the sloped edges of the cathedral ceiling. However, this often appears awkward and does not allow for fixture placement in the center of the room. Other efforts seeking to remedy this problem have involved constructing a flat surface out of typical framing material, then preparing, installing, and painting drywall or a similar finishing surface to the constructed frame. This method is impractical because it requires simultaneous construction with the cathedral ceiling, it is not removable and adaptable elsewhere, and it does not allow for practical placement of a design to be viewed from the floor.

In accordance with the present invention, there is provided a flush mounting method which allows typical ceiling fans and light fixtures to be mounted to the ridge of cathedral ceilings of varying pitch in an aesthetically pleasing manner.

It is thus one object of the present invention to provide a method for providing a fixture mount to be placed at the ridge of a cathedral ceiling to act as a flush surface where a light fixture or ceiling fan is mounted.

It is another object of the present invention to provide a method for providing a fixture mount at the ridge of a cathedral ceiling where a light fixture or ceiling fan is mounted and wherein the fixture mount can be added after construction of the ceiling is complete.

It is a further object of the present invention to provide a method for providing a flat or planar horizontal mounting surface for use in mounting a light fixture or ceiling fan in the center of a room having a cathedral or vaulted ceiling.

It is yet another object of the present invention to provide the user with a method for easily filling the pitch of the intended cathedral ceiling slope without having to know the exact pitch.

It is still another object of the present invention to provide a method for filling the pitch of a cathedral ceiling whereby a light fixture or ceiling fan or other fixture can be easily mounted at whatever pitch angle is encountered in a particular ceiling construction.

It is a further object of the present invention to provide a method for providing a flat surface for fixture mounting to a cathedral ceiling and wherein the flat surface may include a design.

BRIEF DESCRIPTION OF THE DRAWINGS

FIG. 7 is a perspective view of an embodiment in which a solid block piece is used in forming the apparatus used in accordance with the method of the present invention with a cylindrical center opening or bore and with available pitch cut angles show in phantom.

FIG. 8 is a perspective view of a previously cut solid block piece of FIG. 7 with a center bore.

DESCRIPTION OF THE PREFERRED EMBODIMENTS

Figure 1:
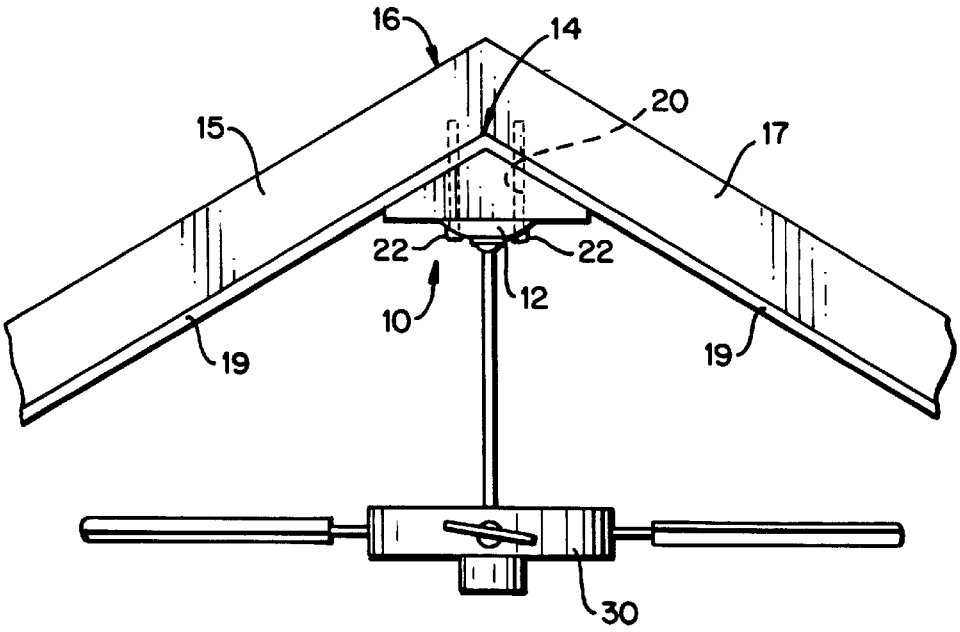
FIG. 1 is a front elevation showing the apparatus used in accordance with the method of the present invention installed with a ceiling fan in a cathedral ceiling.
Figure 2:
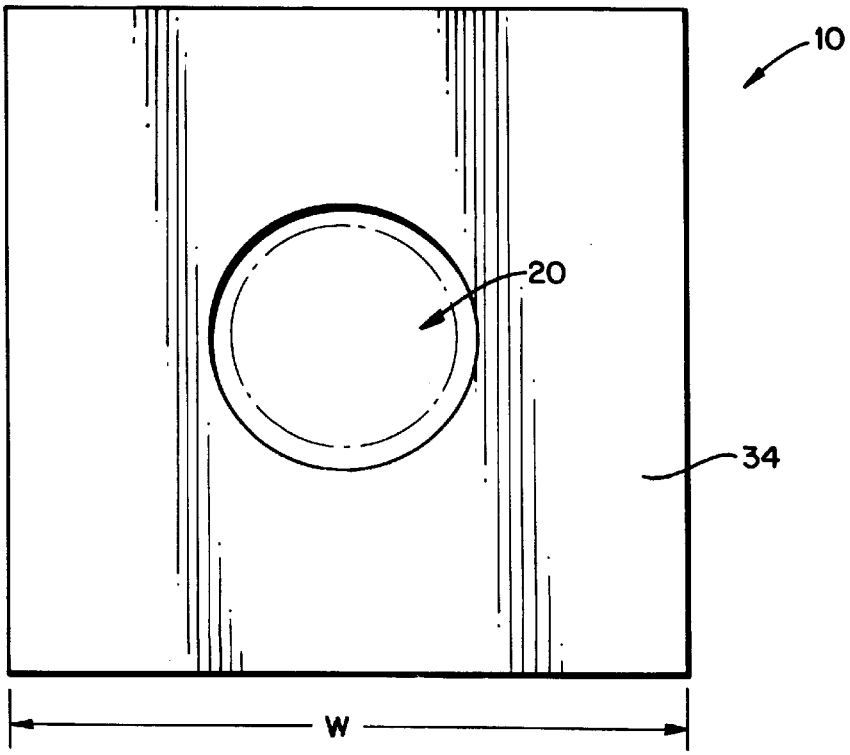
FIG. 2 is a bottom plan view of the apparatus used in accordance with the method of the present invention.
Figure 5:
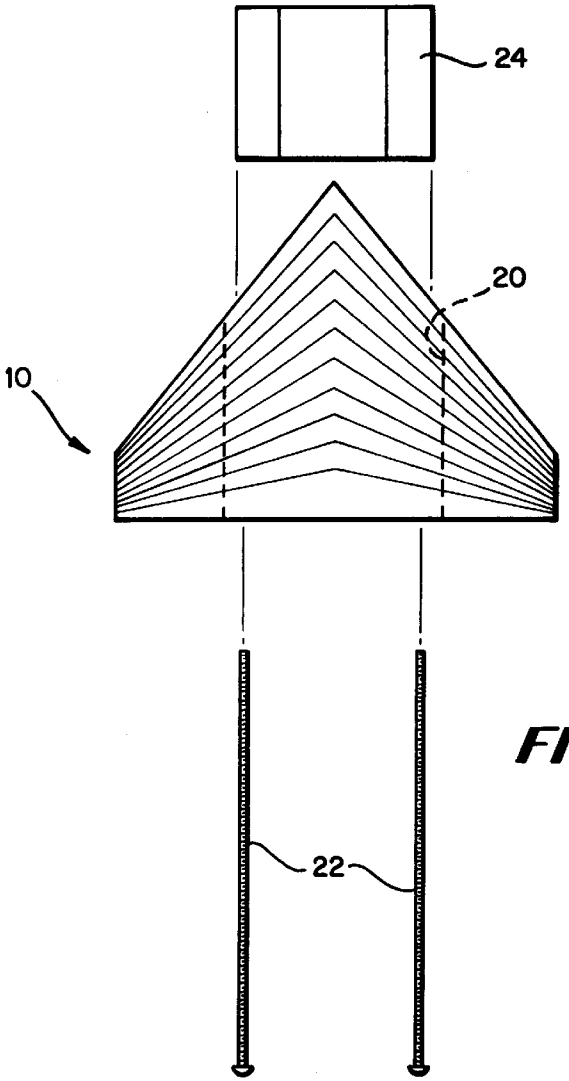
FIG. 5 shows an exploded front view of the apparatus used in accordance with the method of the present invention with standard screws connecting the apparatus to a standard workbox.

In the embodiment of the invention as shown in FIGS. 1 and 2, there is provided a cathedral ceiling fixture mount 10 for placement between a typical fan or lighting fixture boot 12 and the apex 14 of a cathedral ceiling 16. The ceiling 16 may, for example, be formed of a series of rafters or truss members 15, 17 having a drywall layer 19 secured thereto. The fixture mount 10 is provided with a central vertical opening or bore 20. This central bore 20 allows the fixture mount 10 to be firmly secured between the fixture boot 12 and the ceiling 16. The fixture boot 12 is positioned adjacent the bottom surface 34 of the fixture mount 10 so as to encompass the central bore hole 20. Screws 22 or other securing members can then pass through the fixture boot 12 and the central bore 20 and firmly engage a standard ceiling workbox 24, as shown in FIG. 5, which has been previously secured to the truss members 15, 17. The ceiling fan or fixture 30 may be supported either by the workbox 24 or the boot 12. Thus the ceiling 16, and not the fixture mount 10, bears the load of the ceiling fan or fixture 30. In one embodiment, the securing screws 22 make no contact with the fixture mount 10.

The central bore 20 also allows for the connection of necessary electrical wiring from the ceiling workbox 24 to the ceiling fan or fixture 30. The bore 20 must therefore be sufficiently wide to accommodate wiring and securing screws spaced apart to align with threaded openings provided in the standard ceiling workbox 24. In one embodiment of the invention, the bore 20 is approximately four inches in diameter. In another embodiment of the invention, the bore diameter ranges from approximately one-fourth to approximately one-half the width W of the bottom surface 34 of the mount.

In the embodiment of the invention as shown in FIGS. 2, 7 and 8, the fixture mount 10 is made of a single solid piece base member 50 with a central hole 20 bored vertically therethrough. The mount may be provided with a flat, horizontal bottom surface 34 suitable for painting or other decoration to be viewed from below. The material of the solid piece could be a rigid foam material, such as polyurethane, for example, which can be easily cut to the desired shape. The user who already knows the pitch or dimensions of his or her cathedral ceiling can benefit from a one piece embodiment which is pre-shaped or pre-cut to the known pitch angle, as shown in FIG. 8, so as to mate in substantially flush relation with the ceiling at the ridge. This embodiment of the fixture mount 10 would thus have a planar lower surface and two planar upper surfaces, wherein the upper surfaces angle upwardly. Alternatively, the base mount member 50 may be provided as a block, rectangular in cross-section, and having indicia as illustrated by the phantom lines in FIG. 7 to indicate various typical pitch angles which may be cut by the user. This method benefits the user who has not predetermined the pitch angle which will allow the fixture mount 10 to mate in substantially flush relation with the ceiling at the ridge.

Figure 3:
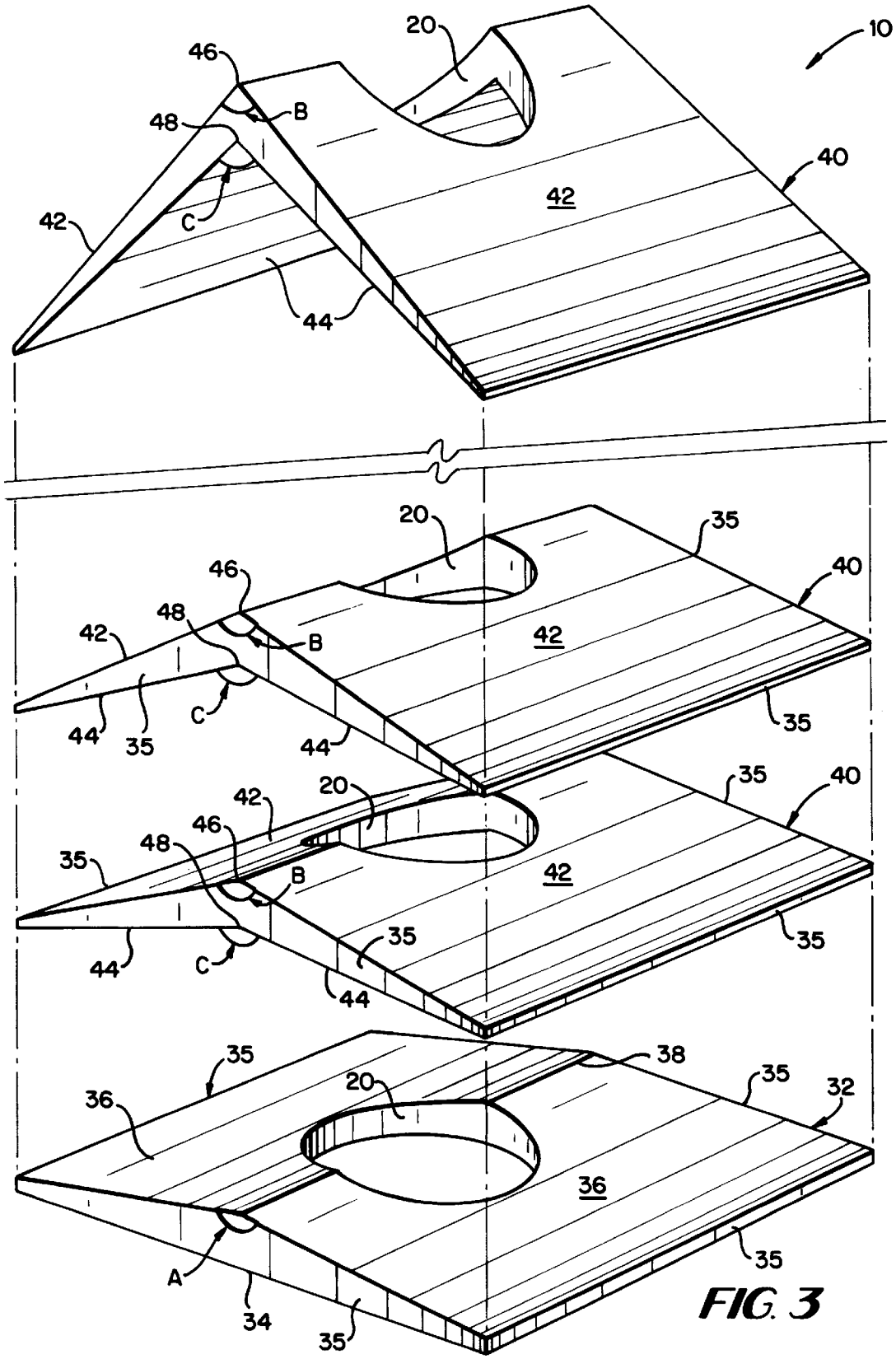
FIG. 3 is an exploded perspective view showing how successive pitch mounts are stacked in accordance with one method of the present invention.
Figure 4:
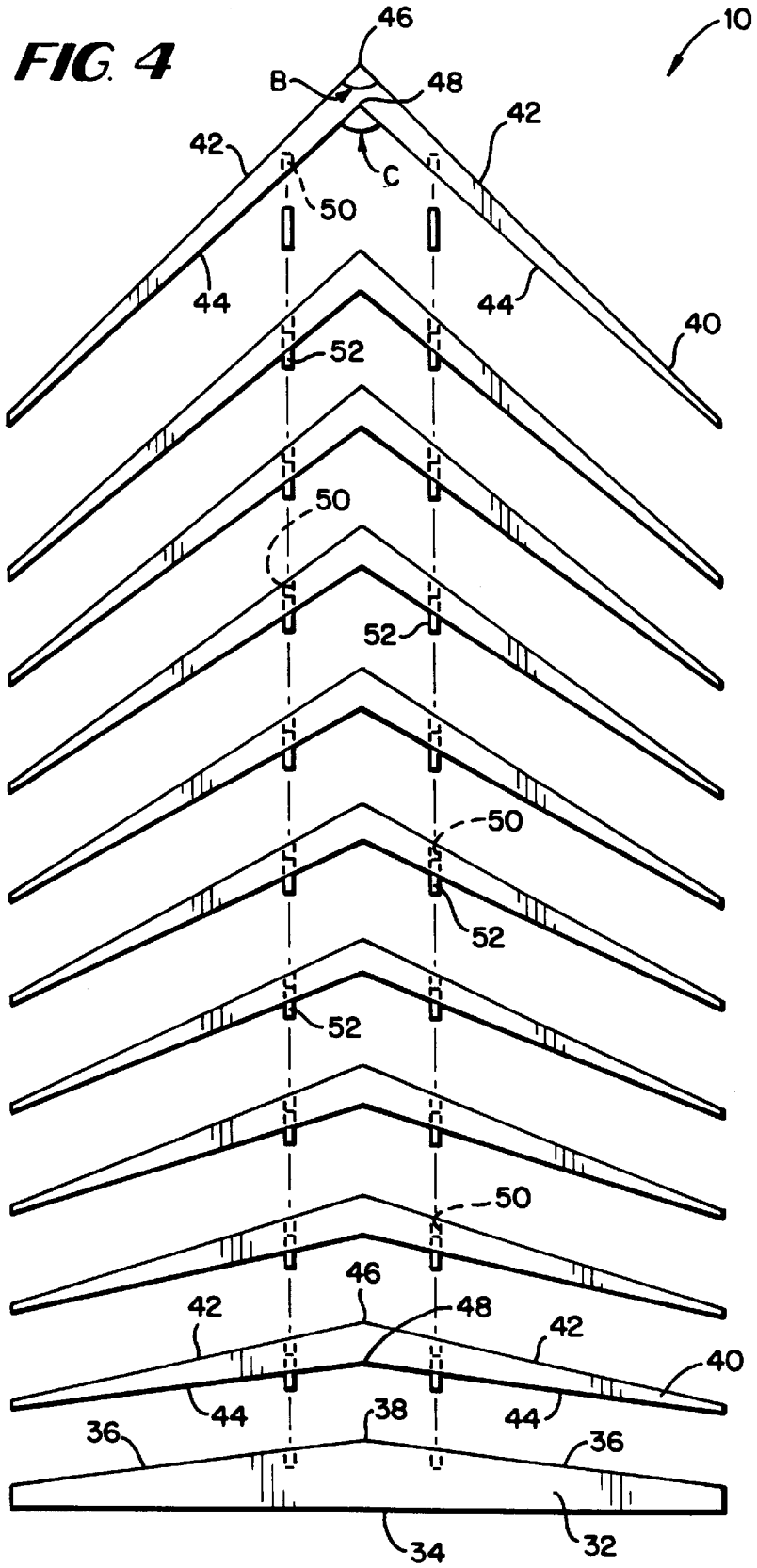
FIG. 4 is an exploded front view of the apparatus used in accordance with the method of the present invention showing a dowel method of attachment for the successive pitch mounts and base mount.

FIGS. 3 and 4 show another method of constructing the fixture mount 10 of the present invention. In FIGS. 3 and 4, there is shown a lower base mount member 32 having a flat, horizontal bottom surface 34 suitable for painting or other decoration to be viewed from below. Fixture boot 12 is positioned against bottom surface 34 and surrounds bore hole 20 when fixture mount 10 is installed as described earlier and as shown in FIG. 1. Base mount 32 is also provided with four vertical side faces 35 and two planar upper surfaces 36 which angle upwardly from the bottom surface 34 and meet at an apex 38 of the base mount 32. The angle "A" created at apex 38 should correspond to the lowest typical pitch angle used in cathedral ceilings. Since ceiling pitches are normally described in two-dimensional terms, the first pitch dimension as described herein is the height of the pitch at the apex and the second pitch dimension is the width of the pitch. For example, a ceiling pitch of 6×12 means that the horizontal distance from one truss member to the other truss member (15 and 17, respectively, in FIG. 1) is twelve inches at a distance of six inches from the apex. In one embodiment of the present invention, the pitch of the base mount member 32 is 2×12.

Resting on top of the base mount 32 is an arrangement of successive pitch mounts 40. Each successive pitch mount 40 has a greater pitch angle than the pitch mount 40 located directly below. Each pitch mount 40 has two planar upper surfaces 42, two planar lower surfaces 44 and four side edges 35. The upper surfaces 42 of each pitch mount 40 meet at an upper apex 46 creating an upper apex angle "B" and the lower surfaces 44 meet at a lower apex 48 creating a lower apex angle "C". In one embodiment, the distance between upper apex 46 and lower apex 48 is one inch. However, this distance may vary in order to provide structural stability to the fixture mount 10 according to the type of material used.

The lower apex angle "C" of the lowest pitch mount 40 is identical to apex angle "A" of base mount 32. Thus, the pitch of the lower surfaces 44 of the lowest pitch mount 40 is the same as the pitch of base mount 32. This allows for flush contact between the lower surfaces 44 of the lowest pitch mount 40 and the upper surfaces 36 of base mount 32. With a single pitch mount 40 attached to base mount 32, the resulting fixture mount 10 is capable of fitting a higher ceiling pitch in substantially flush relation than with just the base mount 32 because the pitch has been increased according to the dimensions of the pitch mount 40. In one embodiment of the invention, the addition of the lowest pitch mount 40 to base mount 32 increases the pitch to 3×12.

The lower surfaces 44 of each successive pitch mount 40 provide flush contact with the upper surfaces 42 of each previous pitch mount 40 due to the lower apex angle "C" of each successive pitch mount 40 being identical to the upper apex angle "B" of each previous pitch mount. Also, the angle "B" of each successive pitch mount 40 will be less than that of the pitch mount 40 located below, thus increasing the pitch angle as additional pitch mounts 40 are installed. Thus, the addition of each successive pitch mount 40 increases the ceiling pitch which can be accommodated by the fixture mount 10 of the present invention. In one embodiment of the invention, a pitch at least as steep as 23×12 can be accommodated.

The attachment of each successive pitch mount 40 to each previous pitch mount 40 and to the base mount 32 can be accomplished in several ways. In the embodiment of the invention as shown in FIG. 4, the upper surfaces 42 of each pitch mount 40 except for the highest pitch mount 40 and the lower surfaces 44 of each pitch mount 40 as well as the upper surfaces 36 of the base mount 32 are all provided with dowel receivers 50 in the form of holes which allow for placement of dowels 52 which will prevent any shifting or sliding motion that might upset the flush appearance of the fixture mount 10. The dowels 52 are of appropriate size to maintain flush contact between the lower surfaces 44 and the upper surfaces 42 of consecutive pitch mounts 40.

Figure 6:
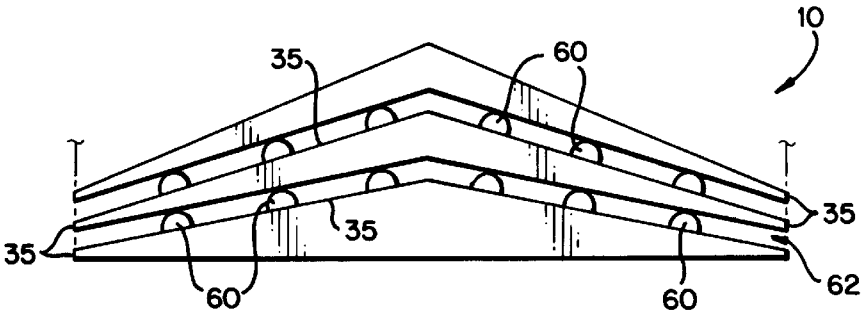
FIG. 6 shows an exploded front view of the apparatus used in accordance with the method of the present invention with pitch connectors being used to attach the successive pitch mounts and the base mount.

In the embodiment of the invention as shown in FIG. 6, pitch connectors 60 may be used instead of dowels 52 and dowel receivers 50. This embodiment allows the fixture mount 10 to be manufactured as a single piece of a lightweight foam material such as Styrofoam with the area 62 between pitch mounts 40 pre-cut with only small pitch connectors 60 of the same Styrofoam material near the side edges 35 of fixture mount 10 holding the fixture mount 10 together. In one embodiment, these pitch connectors 60 would act similar to perforated edges and could be cut away to the desired pitch with a utility knife or similar tool. Any pitch connectors 60 in the remaining portion of the fixture mount 10 being used could then be compressed when the fixture mount 10 is fastened securely between the fixture boot and the ceiling.

It is noted that FIGS. 4 and 6 are intended to be schematic representations showing specific features of the invention and an appropriate opening or bore such as bore 20 in the other drawings would allow the embodiments of FIGS. 4 and 6 to function in accordance with the invention. Thus, the stacked configuration of the base mount 32 and one or more pitch mounts 40 may be secured between the fixture boot and the ceiling in substantially the same manner as described earlier and as shown in FIGS. 1 and 5 for securing the single piece fixture mount to the ceiling at the ridge.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of providing a flush surface for a ceiling fixture at the ridge of an angled or cathedral ceiling, comprising the steps of:

(a) providing a base mount member;

(b) boring a central hole vertically through said base mount member;

(c) shaping said base mount member so as to be receivable by said ceiling ridge in substantially flush relation; and (d) securing said shaped base mount member to said ceiling at said ridge.

2. The method of claim 1 wherein said step of shaping said base mount member includes forming a planar lower surface and two planar upper surfaces, wherein said upper surfaces angle upwardly.

3. The method of claim 2 including the step of forming said two planar upper surfaces to meet at an apex.

4. The method of claim 2 wherein said step of boring a central hole includes boring said hole to have a diameter from approximately one-fourth to approximately one-half the width of said planar lower member.

5. The method of claim 1 wherein said step of boring a central hole includes boring said hole to be approximately four inches in diameter.

6. The method of claim 1 wherein the step of securing said base mount member to the ceiling includes positioning a fixture boot adjacent said planar lower member of said base mount member so as to encompass said hole and extending at least one securing screw through said boot and said hole for connection to a ceiling workbox maintained in said ceiling.

7. A method of providing a flush surface for a ceiling fixture at the ridge of an angled or cathedral ceiling, comprising the steps of:

(a) providing a base mount member having a planar lower surface and two planar upper surfaces which angle upwardly and meet at an apex to form a first pitch angle;

(b) providing at least one pitch mount member having two planar lower surfaces which meet at an apex and two planar upper surfaces which meet at an apex to form a second pitch angle wherein said second pitch angle is steeper than said first pitch angle;

(c) mounting said at least one pitch mount member on said base mount member in a stacked configuration;

(d) boring a central hole vertically through said stacked configuration; and (e) securing said stacked configuration to said ceiling at said ridge such that said stacked configuration mates in substantially flush relation with said ceiling.

* * * * *